US008400253B2

(12) United States Patent
Jung et al.

(10) Patent No.: US 8,400,253 B2
(45) Date of Patent: Mar. 19, 2013

(54) THERMAL FUSE RESISTOR, MANUFACTURING METHOD THEREOF, AND INSTALLATION METHOD THEREOF

(75) Inventors: Jong II Jung, Busan (KR); Doo Won Kang, Anyang-si (KR); Gyu Jin Ahn, Ulsan (KR); Sung Kwang Kim, Ulsan (KR); Kyung Mi Lee, Ulsan (KR)

(73) Assignee: Smart Electronics Inc. (KR)

( * ) Notice: Subject to any disclaimer, the term of this patent is extended or adjusted under 35 U.S.C. 154(b) by 0 days.

(21) Appl. No.: 13/265,741

(22) PCT Filed: Apr. 21, 2010

(86) PCT No.: PCT/KR2010/002499

§ 371 (c)(1),
(2), (4) Date: Oct. 21, 2011

(87) PCT Pub. No.: WO2010/123277

PCT Pub. Date: Oct. 28, 2010

(65) Prior Publication Data

US 2012/0032774 A1 Feb. 9, 2012

(30) Foreign Application Priority Data

Apr. 21, 2009 (KR) ..... 10-2009-0034670

(51) Int. Cl.
*H01H 85/02* (2006.01)
*H01H 37/36* (2006.01)

(52) U.S. Cl. ..... 337/186; 337/182; 337/183; 337/187; 337/414; 337/4; 337/35

(58) Field of Classification Search ..... 337/4, 6, 337/20, 35, 401, 186, 187, 414, 112, 327, 337/380, 398, 182, 183; 361/837; 29/825
See application file for complete search history.

(56) References Cited

U.S. PATENT DOCUMENTS 3,649,942 A 3/1972 Plasko (Continued)

FOREIGN PATENT DOCUMENTS

DE 2140140 2/1972
JP 07-023863 Y2 5/1995

(Continued)

OTHER PUBLICATIONS

JP/2006-310, 429, Nov. 9, 2006_JPO_English_Translation.*

(Continued)

*Primary Examiner* — Anatoly Vortman
(74) *Attorney, Agent, or Firm* — Cantor Colburn LLP

(57) ABSTRACT

Disclosed are a thermal fuse resistor having a case injection-molded by using thermosetting resin having heat resistance less than that of a filler, a manufacturing method of the thermal fuse resistor, and a method of installing the thermal fuse resistor such that a resistor and a thermal fuse are laid down on a printed circuit board. In the thermal fuse resistor, through changing a material of the case, the case has a lighter weight and is not easily broken, so that the thermal fuse resistor is advantageously used for an electronic appliance because of its lightness and slimness. The thickness of the case of the thermal fuse resistor serves as the thickness of the electronic appliance employing the thermal fuse resistor, so that the thermal fuse resistor allows the electronic appliance to have a slim structure.

1 Claim, 8 Drawing Sheets

U.S. PATENT DOCUMENTS

| | | | | |
|---|---|---|---|---|
| 4,494,104 | A * | 1/1985 | Holmes | 337/403 |
| 5,097,247 | A * | 3/1992 | Doerrwaechter | 337/405 |
| 5,621,602 | A | 4/1997 | Winkelmann | |
| 5,712,610 | A * | 1/1998 | Takeichi et al. | 337/290 |
| 6,300,859 | B1 * | 10/2001 | Myong et al. | 337/182 |
| 6,373,371 | B1 * | 4/2002 | Doerrwaechter et al. | 337/297 |
| 6,566,995 | B2 * | 5/2003 | Furuuchi et al. | 337/183 |
| 6,707,370 | B2 * | 3/2004 | Ritt et al. | 337/299 |
| 7,088,216 | B2 * | 8/2006 | Furuuchi | 337/183 |
| 7,265,653 | B2 * | 9/2007 | Rupalla et al. | 337/185 |
| 7,920,044 | B2 * | 4/2011 | Scheiber et al. | 337/186 |
| 8,174,351 | B2 * | 5/2012 | Scheiber et al. | 337/186 |

FOREIGN PATENT DOCUMENTS

| | | | |
|---|---|---|---|
| JP | 02-507073 | Y2 | 5/1996 |
| JP | 2507073 | | 5/1996 |
| JP | 2000285788 | | 10/2000 |
| JP | 2006310003 | | 11/2006 |
| JP | 2006310429 | | 11/2006 |
| JP | 2006310429 | A | 11/2006 |
| JP | 2007103687 | | 4/2007 |
| JP | 2008084797 | | 4/2008 |
| KR | 10-2004-0061182 | A | 7/2004 |
| KR | 20040061182 | A | 7/2004 |
| KR | 10-0527854 | B1 | 11/2005 |
| TW | I267098 | | 11/2006 |

OTHER PUBLICATIONS

Notice of Decision to Grant, Korean Intellectual Property Office, Jun. 8, 2011.

International Search Report for PCT Application No. PCT/KR2010/002499/. Korean Intellectual Property Office. Nov. 29, 2010.

* cited by examiner

THERMAL FUSE RESISTOR, MANUFACTURING METHOD THEREOF, AND INSTALLATION METHOD THEREOF

PRIORITY

The present application claims priority under 35 U.S.C. §371 to PCT Application PCT/KR2010/002499, filed on Apr. 21, 2010, which claims priority to Korean Patent Application No. 10-2009-0034670, filed on Apr. 21, 2009, the disclosures of which are hereby incorporated by reference in their entireties.

TECHNICAL FIELD

The disclosure relates to a thermal fuse resistor, a manufacturing method thereof, and an installation method thereof. More particularly, the disclosure relates to a thermal fuse resistor advantageously used for electronic appliances because of its lightness and slimness, a manufacturing method thereof, and an installation method thereof.

BACKGROUND ART

In general, electrical circuits of large-size electronic appliances, such as an LCD TV and a PDP TV, include a protective device such as a thermal fuse resistor at a power input terminal in order to prevent appliance breakdown caused by an inrush current, the increase of an internal temperature or a continuous over current occurring when the electronic appliance is powered on, so that a power circuit may be protected.

The thermal fuse resistor includes a resistor and a thermal fuse, and the resistor is connected to the thermal fuse in series through lead wires.

In addition, according to the thermal fuse resistor, the resistor and the thermal fuse are packaged in a case and fillers are filled in the case, so that electronic parts can be protected from being damaged by fragments produced when the fusible member is melted.

The fillers have the form of slurry including silicon dioxide ($SiO_2$) to improve the heat-resistant, conductivity and a curing property. The case is made of ceramic used in the case of a typical resistor.

An end of the lead wire extends out of the case, and the thermal fuse resistor according to the related art is mounted on a printed circuit board (PCB) in such a manner that the resistor and the thermal fuse are erected on the PCB by soldering the end of the lead wire on the PCB.

Accordingly, when an inrush current is introduced, the thermal fuse resistor restricts the inrush current to predetermined current by using the resistor. When the over current is introduced, the thermal fuse resistor transfers heat emitted from the resistor to the thermal fuse through the filler to disconnect a circuit such that the fusible member provided in the thermal fuse and including solid-phase lead (Pb) or polymer pellet is melted, thereby protecting electrical circuits of the electronic appliances.

DISCLOSURE

Technical Problem

However, since the thermal fuse resistor according to the related art, which has the case made of ceramic and the resistor erected on the PCB, has a limitation in reducing the thickness or the weight thereof, the thermal fuse resistor may not reduce the weight and the thickness of electronic appliances.

In more detail, since ceramic has specific weight greater than that of other materials except for metals, the thermal fuse resistor having the case made of ceramic with greater specific weight makes it difficult to reduce the weight of the electronic appliance equipped with the thermal fuse resistor.

In the case of an appliance such as an LCD TV or a PDP TV, the actual thickness of the appliance excluding an external frame and a liquid crystal is determined by a PCB installed in the frame and an element (e.g., thermal fuse resistor) mounted on the PCB. However, if the thermal fuse resistor is mounted on the PCB in an erected state, the whole length of the case may serve as the thickness of the appliance. For this reason, the electronic appliance employing the thermal fuse resistor may not have a slim structure.

The ceramic case is manufactured by sintering ceramic powders. If an inner wall of the case has the thickness of 1.5 mm or less, the ceramic case may easily be broken due to the characteristic of ceramic having great brittleness while carrying the case or manufacturing the case. In a sintering process, since typical ceramic represents a high shrinkage rate of about ±0.5 mm or more, the inner wall of the case has to be designed with the thickness of 2.5 mm or more by taking the shrinkage rate into consideration so that the inner wall of the case having the thickness of 2.0 mm can be obtained. Accordingly, as described above, according to the thermal fuse resistor of the related art, the thickness of the case may not be effectively reduced due to the material characteristics of the case such as great brittleness and the high shrinkage rate. This also may be detrimental to the production of a slim electronic appliance.

Technical Solution

Accordingly, it is an aspect of the disclosure to provide a thermal fuse resistor advantageously used for electronic appliances in terms of lightness and slimness, a manufacturing method thereof, and an installation method thereof.

Additional aspects and/or advantages of the disclosure will be set forth in part in the description which follows and, in part, will be apparent from the description, or may be learned by practice of the disclosure.

The foregoing and/or other aspects of the disclosure are achieved by providing a thermal fuse resistor including a resistor, a thermal fuse disconnecting a circuit as heat is applied thereto from the resistor, a lead wire connecting the resistor with the thermal fuse in series, a case provided with an open surface used to receive the resistor and the thermal fuse therein in a state in which an end of the lead wire is drawn out of the case and provided at one wall surface thereof with a drawing groove used to draw the lead wire, and a filler filled in the case to bury the resistor and the thermal fuse therein and including silicon dioxide. The case is formed by injection-molding thermosetting resin having heat resistance less than heat resistance of the filler.

According to the disclosure, the resistor and the thermal fuse are provided in the case such that the resistor and the thermal fuse face the open surface side by side, and a wall surface of the case facing the open surface has a thickness in a range of about 0.5 mm to about 1.5 mm.

According to another aspect of the disclosure, there is provided a manufacturing method of a thermal fuse resistor. The manufacturing method includes connecting a resistor and a thermal fuse to each other in series by using a lead wire, injection-molding a case to receive the resistor and the thermal fuse therein by using thermosetting resin, inserting the resistor and the thermal fuse into the case in a state that an end of the lead wire is drawn out of the case, filling the case, in which the resistor and the thermal fuse have been received, with a filler including silicon dioxide and having a form of slurry, and drying the filler.

According to still another aspect of the disclosure, there is provided an installation method of a thermal fuse resistor including a resistor, a thermal fuse disconnecting a circuit as heat is applied thereto from the resistor, a lead wire connecting the resistor with the thermal fuse in series, a case including thermosetting resin, an open surface used to receive the resistor and the thermal fuse therein in a state in which an end of the lead wire is drawn out of the case, a drawing groove used to draw the lead wire at one wall surface of the case, and a filler filled in the case to receive the resistor and the thermal fuse therein. The installation method includes soldering the lead wire drawn out of the case onto a printed circuit board, and bending a lead wire provided between the case and the printed circuit board to allow the open surface of the case to face the printed circuit board, so that the resistor and the thermal fuse are laid down on the printed circuit board.

ADVANTAGEOUS EFFECTS

As described above, in the thermal fuse resistor and the manufacturing method thereof according to the disclosure, the case is injection-molded by using thermosetting resin having heat resistance less than that of a filler of the case.

Therefore, the thermal fuse resistor according to the disclosure is more advantageously used for an electronic appliance, which employs the thermal fuse resistor, in terms of lightness and slimness as compared with a thermal fuse resistor according to the related art because the case of the thermal fuse resistor according to the disclosure is not easily broken even if the weight and the thickness of the case are reduced.

In the installation method of the thermal fuse resistor according to the disclosure, the thermal fuse resistor faces the printed circuit board such that the resistor and the thermal fuse are laid down on the printed circuit board. Therefore, only the thickness of the case provided in the thermal fuse resistor is applied to the thickness of the electronic appliance, so that the thermal fuse resistor can be advantageously used for the electronic appliance employing the thermal fuse resistor in terms of lightness and slimness.

DESCRIPTION OF DRAWINGS

These and/or other aspects and advantages of the disclosure will become apparent and more readily appreciated from the following description of the embodiments, taken in conjunction with the accompanying drawings of which.

BEST MODE

Figure 1:
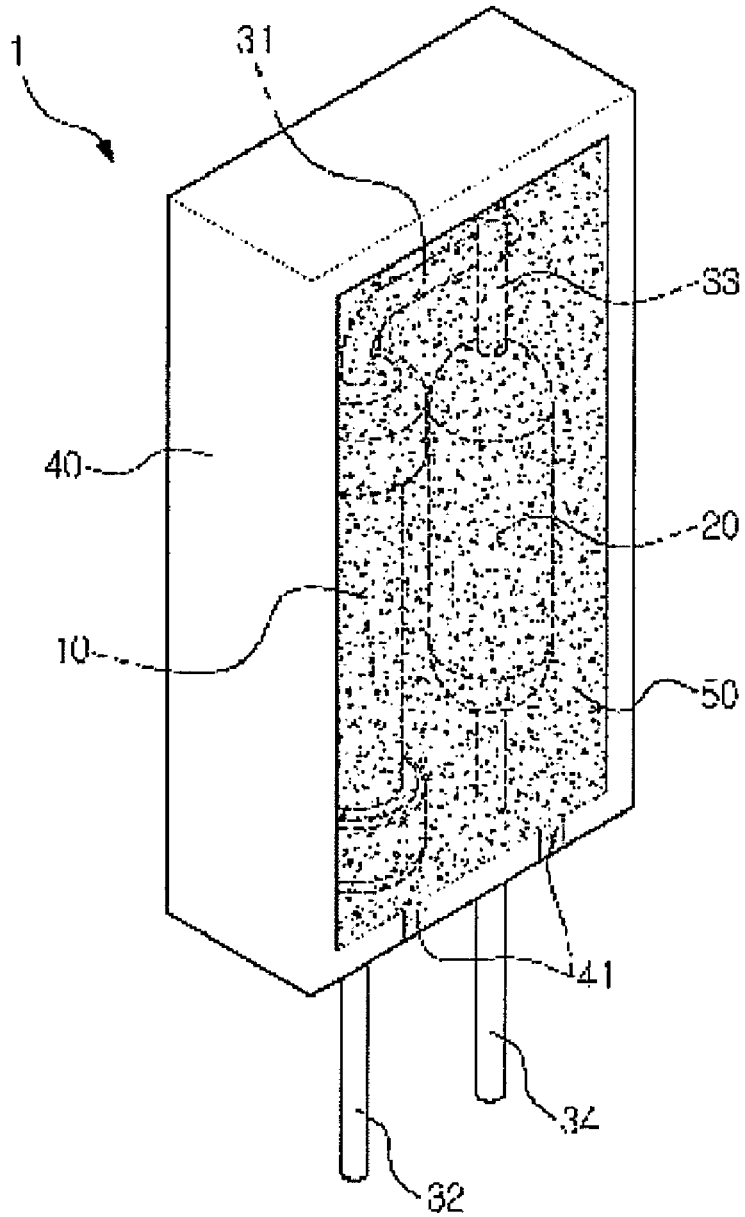
FIG. 1 is a perspective view showing the structure of a thermal fuse resistor according to one exemplary embodiment of the disclosure.

Reference will now be made in detail to the embodiments of the disclosure, examples of which are illustrated in the accompanying drawings, wherein like reference numerals refer to the like elements. The embodiments are described below to explain the disclosure by referring to the figures.

Hereinafter, the structure of a thermal fuse resistor 1 and a manufacturing method thereof according to an exemplary embodiment of the disclosure will be described in detail with reference to accompanying drawings.

As shown in FIG. 1, the thermal fuse resistor 1 according to the present embodiment is employed in an electrical circuit of a large-size electronic appliance such as an LCD TV or a PDP TV, and includes a resistor 10, a thermal fuse 20 to disconnect a circuit by a heating-emitting action of the resistor 10, and lead wires 31, 32, 33, and 34 to connect the resistor 10 to the thermal fuse 20 in series.

The resistor 10 may be generally implemented as a cement resistor. The resistor 10 may be a device (e.g., negative temperature coefficient (NTC) element) to restrict an inrush current. The resistor 10 may be formed by winding an alloy wire of copper (Cu) and nickel (Ni) around a ceramic rod such that the resistor 10 is not melted by high current, but endures the high current. The first and second lead wires 31 and 32 are connected to both ends of the resistor 10.

The thermal fuse 20 may include a fusible member (not shown) wound around an insulating ceramic rod having a predetermined length. The lead wires 31, 32, 33, and 34 may include the third and fourth lead wires 33 and 34 electrically connected to conductive caps installed at both ends of the insulation ceramic rod. Since the various types of thermal fuses 20 melted by the heat of the resistor 10 are generally known to those skilled in the art, details thereof will be omitted in order to avoid redundancy.

The first lead wire 31 of the resistor 10 is connected to the third lead wire 33 of the thermal fuse 20 in series through arc welding or spot welding.

In thermal fuse resistor 1, the resistor 10 and the thermal fuse 20 are packaged in a case 40 to prevent electronic parts, which are mounted on a printed circuit board (PCB) 2 together with the thermal fuse resistor 1, from being damaged by fragments produced when the fusible member is melted, and a filler 50 is filled in the case 40.

The case 40 has one open surface such that the resistor 10 and the thermal fuse 20 are easy to be inserted therein. The case 40 has a hollow-type rectangular parallelepiped shape with a thickness less than a length such that the shape of the case 40 corresponds to the rod shape of both the resistor 10 and the thermal fuse 20. The resistor 10 and the thermal fuse 20 received in the case 40 face the open surface of the case 40 side by side. The case 40 is provided in one shorter wall surface thereof with a pair of drawing grooves 41 to draw the second and fourth lead wires 32 and 34 out of the case 40. Since the diameter of the resistor 10 is greater than the diameter of the thermal fuse 20, the depth of an internal receiving space 40*a* of the case 40 is slightly greater than the diameter of the resistor 10 such that the case 40 has a reduced thickness.

The filler 50 includes silicon dioxide ($SiO_2$) provided by taking the heat-resistant, conductivity, and a curing property into consideration. The filler 50 is provided in the form of slurry in which $SiO_2$ is mixed with silicon serving as an adhesive. Then, the filler 50 is cured through a drying process in the case 40.

The thermal fuse resistor 1 having the above structure is mounted on the PCB 2 such that the second and fourth lead wires 32 and 34 drawn out of the case 4 are soldered on the PCB 2. Accordingly, when the inrush current is introduced, the thermal fuse resistor 1 restricts the inrush current to a predetermined current by using the resistor 10. When over current is introduced, the thermal fuse resistor 1 transfers heat emitted from the resistor 10 to the thermal fuse 20 through the filler 50 to disconnect a circuit such that the fusible member including solid-phase lead (Pb) or polymer pellet provided in the thermal fuse 20 is melted, thereby protecting an electrical circuit of an electronic appliance.

According to the thermal fuse resistor 1 of the present embodiment, the case 40 is injection-molded by using thermosetting resin having heat resistance less than that of the filler 550 such that the thermal fuse resistor 1 is advantageously used for the electronic appliance, which employs the thermal fuse resistor 1, because of its lightness and slimness.

In more detail, according to the thermal fuse resistor 1 of the present embodiment, since the resistor 10 and the thermal fuse 20 are buried in the filler 50, heat emitted from the resistor 10 is transferred to the thermal fuse 20 through the filler 50. Accordingly, the heat of the resistor 10 is directly transferred to the filler 50, and indirectly transferred to the case 40. Therefore, even if the case 40 is formed by using thermosetting resin having heat resistance less than that of the filler 50, the case 40 is not deformed or damaged due to the heat of the resistor 10, thereby preventing the performance of the thermal fuse resistor 1 from being degraded. The thermosetting resin does not degrade the performance of the thermal fuse resistor 1, and has specific weight still less than that of ceramic constituting a case of a thermal fuse resistor according to the related art, so that the weight of the thermal fuse resistor 1 may be reduced as compared with the thermal fuse resistor according to the related art. Therefore, the thermal fuse resistor 1 may be advantageously used for the electronic appliance, which employs the thermal fuse resistor 1, because of its lightness.

Since the thermosetting resin is not easily broken as compared with the ceramic, even if the case 40 has a reduced thickness, the case 40 may be prevented from being damaged when the case 40 is carried or manufactured. The injection molding refers to the process for producing a product by injecting molten resin material into the cavity of an injection mold. The product produced through the injection molding is hardly shrunken, so the shrinkage rate of the product may be controlled within the range of about ±0.1 mm or less.

Therefore, in the thermal fuse resistor 1 according to the present embodiment, the wall surface of the case 40 can be more exactly formed at a thickness in the range of about 0.5 mm to about 1.5 mm. Even if the inner wall of the case 40 is formed at a reduced thickness as described above, the case 40 can be prevented from being damaged due to shock when the case 40 is carried or manufactured.

In an installation structure of the thermal fuse resistor 1 according to the present embodiment, which will be described below, the thickness of a wall surface of the case 40 provided in opposition to the open surface of the case 40 exerts a direct influence on the thickness of an electronic appliance employing the thermal fuse resistor 1. Accordingly, all wall surfaces of the case 40 are preferably formed at a thickness in the range of about 0.5 mm to about 1.5 mm when both of the lightness and the slimness of the electronic appliance employing the thermal fuse resistor 1 are taken into consideration. If only the slimness of the electronic appliance employing the thermal fuse resistor 1 is taken into consideration, only the wall surface provided in opposition to the open surface may have a thickness in the range of about 0.5 mm to 1.5 mm.

The thermal fuse resistor 1 is designed through the following manufacturing process.

Figure 2:
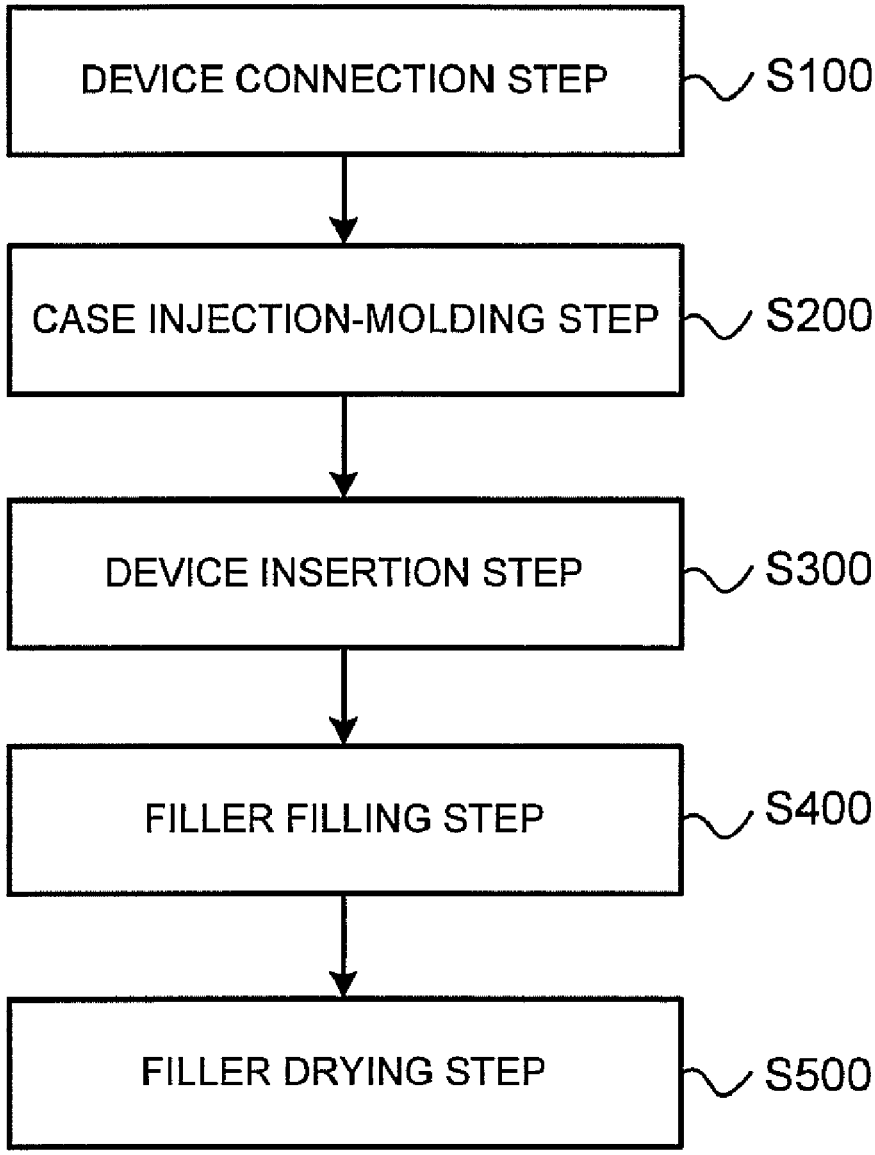
FIG. 2 is a flowchart sequentially showing the manufacturing procedure of the thermal fuse resistor according to one exemplary embodiment of the disclosure.

As shown in FIG. 2, the thermal fuse resistor 1 according to the present embodiment is manufactured through a device connection step (S100) of connecting the resistor 10 with the thermal fuse 20 in series by using the lead wires 31, 32, 33, and 34, a case injection-molding step (S200) of injection-molding the case 40 to receive the resistor 10 and the thermal fuse 20 therein by using thermosetting resin, a device insertion step (S300) of inserting the resistor 10 and the thermal fuse 20 into the receiving space of the case 40 while drawing the ends of the lead wires 32 and 34 out of the case 40, a filler filling step (S400) of filling the case 40, in which the resistor 10 and the thermal fuse 20 have been received, with the filler 50 including $SiO_2$ which is provided in the form of slurry, and a filler drying step (S500) of drying the filler 50 filled in the case 40.

Figure 3:
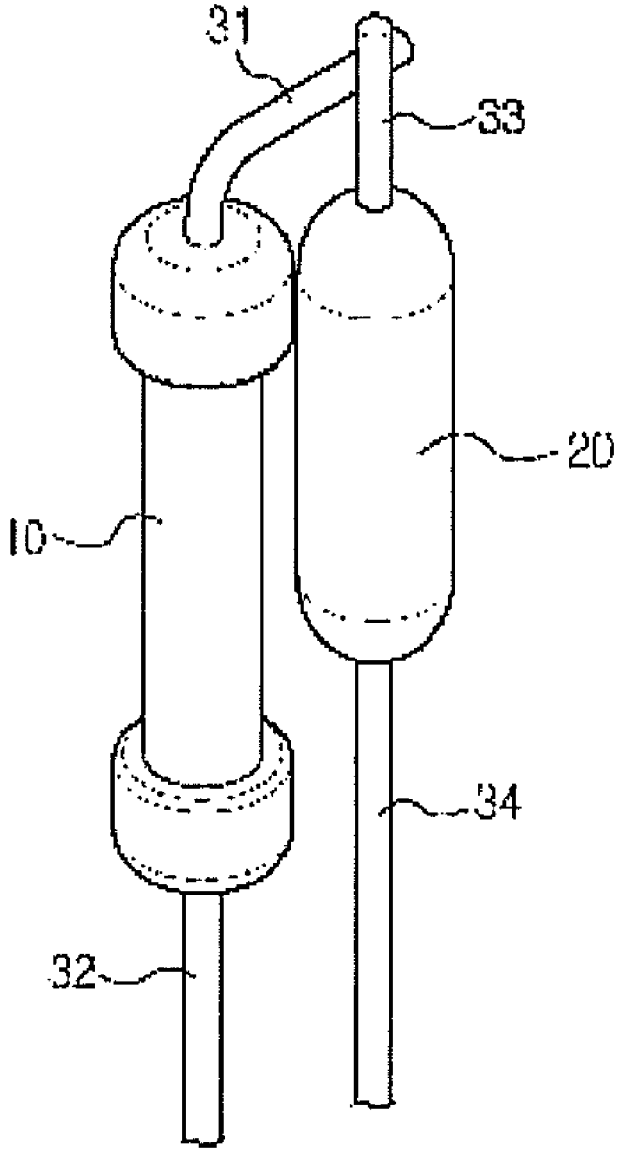
FIG. 3 is a perspective view showing a state in which a device connection step has been completed in the manufacturing process of the thermal fuse resistor according to one exemplary embodiment of the disclosure.

The device connection step S100 and the case injection-molding step S200 may be performed regardless of the sequence thereof. In the device connection step S100, as shown in FIG. 3, the end of the first lead wire 31 of the resistor 10 is connected to the end of the third lead wire 33 of the thermal fuse 20 in series through arc welding or spot welding.

Figure 4:
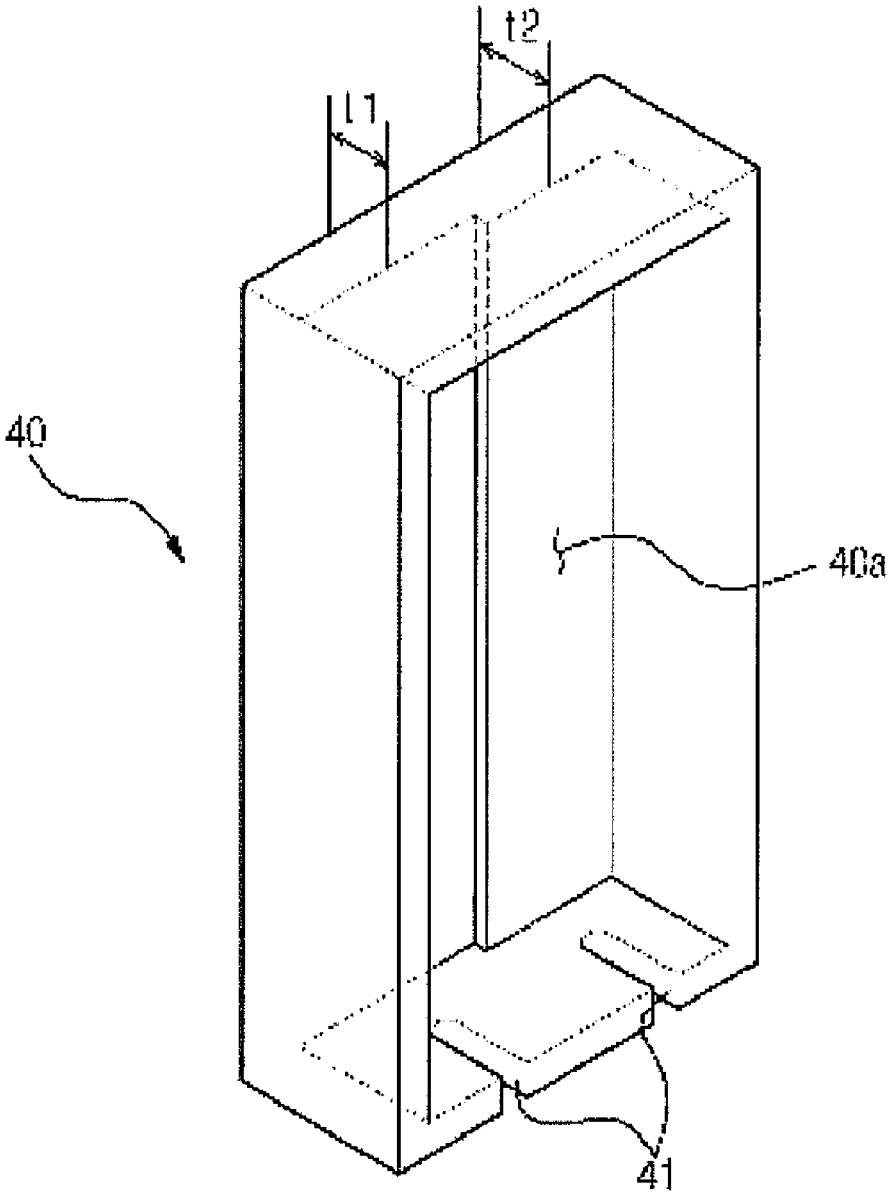
FIG. 4 is a perspective view showing the structure of a case formed through an injection-molding step in the manufacturing process of the thermal fuse resistor according to one exemplary embodiment of the disclosure.

In the case injection-molding step S200, molten thermosetting resin is injected into the cavity of an injection mold formed in the shape of the case 40 to injection-mold the case 40 having one open surface and provided with a pair of drawing grooves 41, which are used to draw the second and fourth lead wires 32 and 34, at one inner wall of the case 40 of one end of the case 40 in a longitudinal direction as shown in FIG. 4. In this case, the wall surface of the case 40 is injection-molded at the thickness in the range of about 0.5 mm to about 1.5 mm such that the thermal fuse resistor 1 and the electronic appliance employing the thermal fuse resistor 1 are implemented with a reduced at slim thicknesses. When the injection-molding is performed, the case 40 is hardly shrunken so that the shrinkage rate of the case 40 may be controlled within the range of about ±0.1 mm or less. Accordingly, the wall surface of the case 40 is formed at the thickness as originally designed. Since the diameter of the resistor 10 is greater than that of the thermal fuse 20, a part of the wall surface of the case 40, which is provided in opposition to the open surface of the case 40 and placed corresponding to the resistor 10, has a thickness exceeding that of a part of the wall surface placed corresponding to the thermal fuse 20 such that the resistor 10 and the thermal fuse 20 received in the receiving space 40*a* of the case 40 can be aligned in line with each other. Therefore, according to the present embodiment, the wall surface of the case 40 provided in opposition to the open surface of the case

40 has a thickness t1 of about 0.7 mm at the side of the resistor 10, and has a thickness t2 of about 1.2 mm at the side of the thermal fuse 20.

Figure 5:
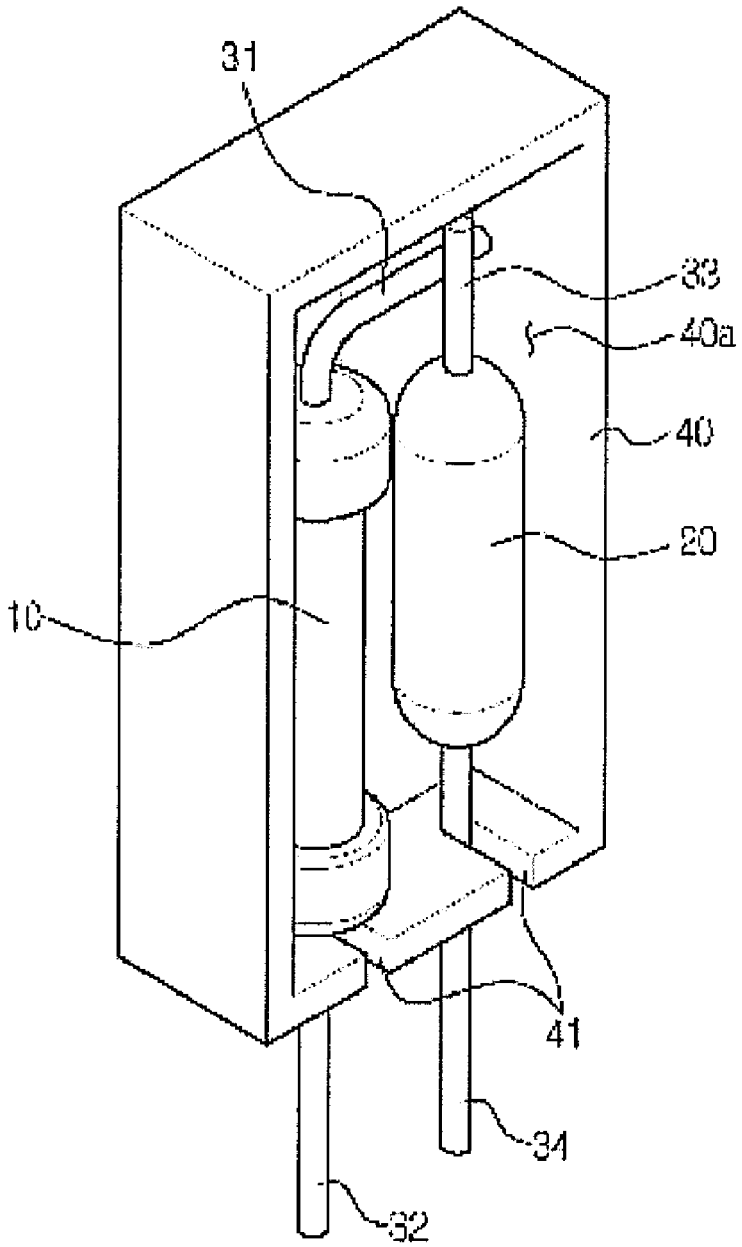
FIG. 5 is a perspective view showing a state in which a device insertion step has been completed in the manufacturing process of the thermal fuse resistor according to one exemplary embodiment of the disclosure.
Figure 6:
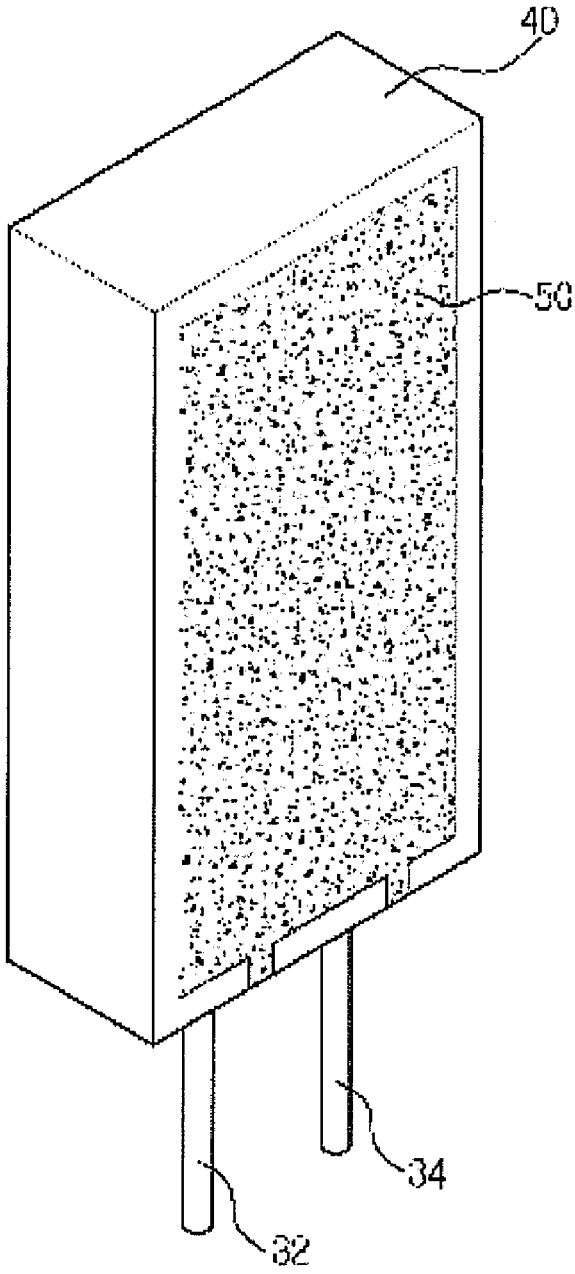
FIG. 6 is a perspective view showing a state in which a filler filling step has been completed in the manufacturing process of the thermal fuse resistor according to one exemplary embodiment of the disclosure.

When the device connection step (S100) and the case injection-molding step (S200) have been finished, the device insertion step (S300) is performed. As shown in FIG. 5, the second and fourth lead wires 32 and 34 are drawn out of the case 40 through the drawing groove 41 in the device insertion step (S300), and the resistor 10 and the thermal fuse 20 are inserted into the receiving space 40*a* of the case 40 such that the resistor 10 and the thermal fuse 20 face the open surface of the case 40 side by side. Thereafter, in the filler filling step (S400), the filler 50 having the form of slurry is filled in the case 40 that have been subject to the device insertion step (S300) as shown in FIG. 6. The fuse resistor 1 that has been subject to the filler filling step (S400) is finally manufactured through the filler drying step (S500) of drying the filler 50 for one day or two days.

Figure 7:
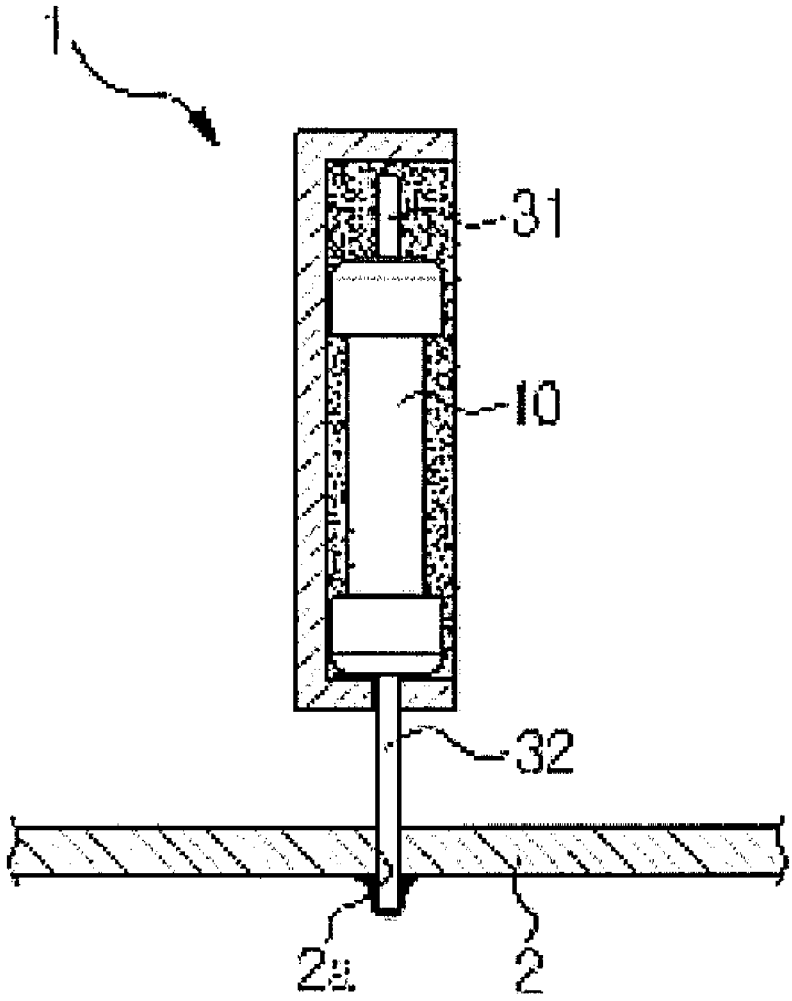
FIG. 7 is a side view showing a state in which a soldering step has been completed in an installation procedure of the thermal fuse resistor according to one exemplary embodiment of the disclosure.
Figure 8:
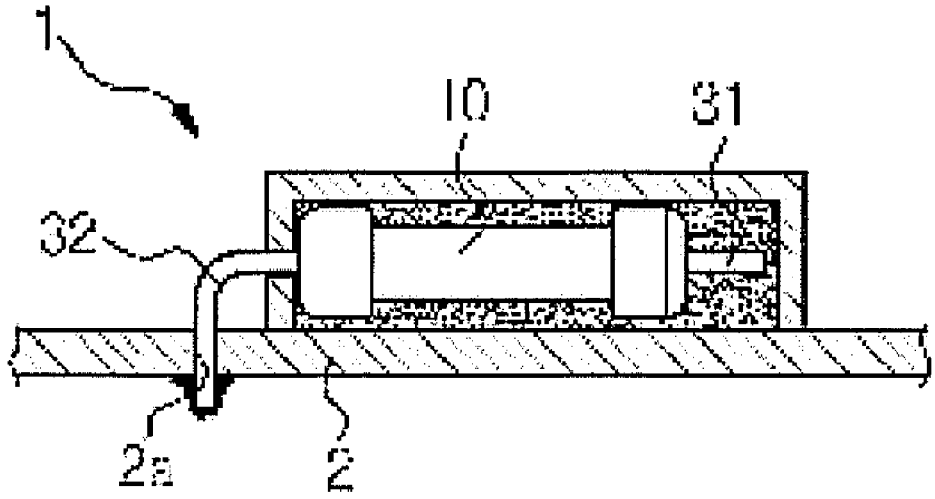
FIG. 8 is a side view showing a state in which a bending step has been completed in the installation procedure of the thermal fuse resistor according to one exemplary embodiment of the disclosure.

The thermal fuse resistor 1 according to the present embodiment is installed on the PCB 2 in the form different from that of a thermal fuse resistor according to the related art in order to provide the electronic appliance having the slim structure. FIGS. 7 and 8 are views sequentially showing the installation procedures of the thermal fuse resistor 1 according to the present embodiment.

As shown in FIG. 7, when the thermal fuse resistor 1 according to the present embodiment is installed on the PCB 2, a soldering step is performed to fix the thermal fuse resistor 1 onto the PCB 2 by soldering a peripheral portion of an installation hole 2*a* in a state in which the second and fourth lead wires 32 and 34 drawn out of the case 40 are inserted into the insertion hole 2*a*. In this state, the resistor 10 and the thermal fuse 20 are erected on the PCB 2, and the case 40 is spaced apart from the PCB 2 with a predetermined distance due to the second and fourth lead wires 32 and 34. Then, as shown in FIG. 8, the thermal fuse resistor 1 is completely installed on the PCB 2 through a bending step of allowing the open surface of the case 40 to face the PCB 2 by bending the second and fourth lead wires 32 and 34 provided between the case 40 and the PCB 2, so that the resistor 10 and the thermal fuse 20 are laid down on the PCB 2.

In the case of an appliance such as an LCD TV or a PDP TV, the actual thickness of the appliance excluding an external frame and a liquid crystal is determined by all of the PCB 2 and a device such as the thermal fuse resistor 1 mounted on the PCB 2, which are provided in the external frame. Therefore, if the thermal fuse resistor 1 according to the present embodiment is installed on the PCB 2 in a thickness direction such that the thermal fuse resistor 1 faces the PCB 2, the thickness of the case 40 of the thermal fuse resistor 1 may serve as the thickness of the electronic appliance. Accordingly, the fuse resistor 1 according to the present embodiment can be more advantageously used for the electronic appliance because of its slimness.

Although few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A thermal fuse resistor comprising:

a resistor;

a thermal fuse disconnecting a circuit as heat is applied thereto from the resistor;

a lead wire connecting the resistor with the thermal fuse in series;

a case provided with an open surface used to receive the resistor and the thermal fuse therein in a state in which an end of the lead wire is drawn out of the case and provided at one wall surface thereof with a drawing groove used to draw the lead wire; and a filler filled in the case to bury the resistor and the thermal fuse therein and including silicon dioxide, wherein the case is formed by injection-molding thermosetting resin having heat resistance less than heat resistance of the filler, the resistor and the thermal fuse are provided in the case such that the resistor and the thermal fuse face the open surface side by side, a wall surface of the case facing the open surface has a thickness in a range of about 0.5 mm to about 1.5 mm, and a thickness of a first portion of the wall of the case in which the resistor is provided is smaller than a thickness of a second portion of the wall of the case in which the thermal fuse is provided, such that the resistor and the thermal fuse, both provided in the case, are aligned with each other on substantially the same level relative to the open surface.

* * * * *